US009492825B2

(12) United States Patent
Howell et al.

(10) Patent No.: US 9,492,825 B2
(45) Date of Patent: Nov. 15, 2016

(54) THERMAL CONTROL APPARATUS FOR CHEMICAL AND BIOCHEMICAL REACTIONS

(75) Inventors: James Richard Howell, Stokesley (GB); Benjamin Masterman Webster, Saltburn (GB)

(73) Assignee: IT-IS International Limited (GB)

( * ) Notice: Subject to any disclaimer, the term of this patent is extended or adjusted under 35 U.S.C. 154(b) by 503 days.

(21) Appl. No.: 12/676,805

(22) PCT Filed: Sep. 5, 2008

(86) PCT No.: PCT/GB2008/002992

§ 371 (c)(1),
(2), (4) Date: Mar. 5, 2010

(87) PCT Pub. No.: WO2009/030908

PCT Pub. Date: Mar. 12, 2009

(65) Prior Publication Data

US 2010/0303690 A1 Dec. 2, 2010

Related U.S. Application Data

(60) Provisional application No. 60/970,401, filed on Sep. 6, 2007.

(51) Int. Cl.

| | |
|---|---|
| ***B01L 3/00*** | (2006.01) |
| ***B01L 7/00*** | (2006.01) |
| ***B01L 9/00*** | (2006.01) |

(52) U.S. Cl.

CPC ..... *B01L 3/50853* (2013.01); *B01L 3/50851* (2013.01); *B01L 7/52* (2013.01); *B01L 9/00* (2013.01); *B01L 2200/12* (2013.01); *B01L 2300/12* (2013.01); *B01L 2300/1827* (2013.01)

(58) Field of Classification Search

CPC ..... B01L 3/5085; B01L 2300/0829
USPC ..... 422/552, 553, 102
See application file for complete search history.

(56) References Cited

U.S. PATENT DOCUMENTS

| | | | | |
|---|---|---|---|---|
| 2003/0064508 | A1* | 4/2003 | Kwasnoski et al. | 435/288.4 |
| 2004/0248146 | A2* | 12/2004 | Atwood et al. | 435/6 |
| 2005/0226782 | A1 | 10/2005 | Reed et al. | |

FOREIGN PATENT DOCUMENTS

| | | | |
|---|---|---|---|
| EP | 0 338 159 | A | 10/1989 |
| EP | 1 161 994 | A | 12/2001 |

(Continued)

*Primary Examiner* — Natalia Levkovich
(74) *Attorney, Agent, or Firm* — Hartman Global IP Law; Gary M. Hartman; Domenica N. S. Hartman

(57) ABSTRACT

An apparatus (40) for a PCR reaction includes an array (41) of reaction vessels (42) is mounted on a thermal mount (43). The thermal mount (43) is positioned on a on a heater/cooler (45), such as a Peltier module. The array (41) is covered by a sealing film (44), which is sealed to the upper rims (49) of the vessels (42) to keep the reagents and reaction products within each vessel (42). A heated lid (50) is used to heat the underside of the sealing film to reduce condensation thereon of reagents vaporized during the reaction. The reaction vessels (42) are formed of an upper, thermally insulating part (25) and a lower, thermally conducting part (21) so as to facilitate accurate temperature control within the vessels but so as to reduce the amount of thermal energy conducted from the heated lid to the vessels, which would reduce the accuracy of the temperature control. The heated lid (50) may include a conformal layer (51) on its lower surface to conform to any variations in the configuration of the upper rims (49) of the vessels (42). The apparatus may include a thermal barrier between the lower portion (21) of the reaction vessels (42) and the heated lid (50).

15 Claims, 4 Drawing Sheets

(56) References Cited

FOREIGN PATENT DOCUMENTS

| | | | |
|---|---|---|---|
| EP | 1 974 818 | A | 10/2008 |
| GB | 2 370 112 | A | 6/2002 |
| WO | WO 96/26008 | A | 8/1996 |
| WO | WO 00/29114 | A | 5/2000 |
| WO | WO 2004/045772 | A | 6/2004 |
| WO | WO 2005/028109 | A | 3/2005 |

* cited by examiner

THERMAL CONTROL APPARATUS FOR CHEMICAL AND BIOCHEMICAL REACTIONS

CROSS-REFERENCE TO RELATED APPLICATIONS

The present application is the U.S. National Phase entry under 35 U.S.C. §371 of International Application No. PCT/GB2008/002992, filed Sep. 5, 2008, which claims the benefit under 35 U.S.C. §119(e) of U.S. Application No. 60/970,401, filed on Sep. 9, 2007.

The present invention relates to a method and system for thermal control of chemical and/or biochemical reactions, such as, but not limited to, Polymerase Chain Reactions (PCR).

Many chemical and biochemical reactions are carried out which require highly accurately controlled temperature variations. Often, such reactions may need to go through several, or even many, cycles of varying temperature in order to produce the required effects.

A particular example of a reaction where a relatively large number of highly accurately controlled temperature varying cycles are required is in nucleic acid amplification techniques and in particular the polymerase chain reaction (PCR). Amplification of DNA by polymerase chain reaction (PCR) is a technique fundamental to molecular biology. PCR is a widely used and effective technique for detecting the presence of specific nucleic acids within a sample, even where the relative amounts of the target nucleic acid are low. Thus it is useful in a wide variety of fields, including diagnostics and detection as well as in research.

Nucleic acid analysis by PCR requires sample preparation, amplification, and product analysis. Although these steps are usually performed sequentially, amplification and analysis can occur simultaneously.

In the course of the PCR, a specific target nucleic acid is amplified by a series of reiterations of a cycle of steps in which nucleic acids present in the reaction mixture are denatured at relatively high temperatures, for example at 95° C. (denaturation), then the reaction mixture is cooled to a temperature at which short oligonucleotide primers bind to the single stranded target nucleic acid, for example at 55° C. (annealing). Thereafter, the primers are extended using a polymerase enzyme, for example at 72° C. (extension), so that the original nucleic acid sequence has been replicated. Repeated cycles of denaturation, annealing and extension result in the exponential increase in the amount of target nucleic acid present in the sample.

Variations of this thermal profile are possible, for example by cycling between denaturation and annealing temperatures only, or by modifying one or more of the temperatures from cycle to cycle.

DNA dyes or fluorescent probes can be added to the PCR mixture before amplification and used to analyse the progress of the PCR during amplification. These kinetic measurements allow for the possibility that the amount of nucleic acid present in the original sample can be quantitated.

Monitoring fluorescence during each cycle of PCR initially involved the use of a fluorophore in the form of an intercalating dye such as ethidium bromide, whose fluorescence changed when intercalated within a double stranded nucleic acid molecule, as compared to when it is free in solution. These dyes can also be used to create melting point curves, as monitoring the fluorescent signal they produce as a double stranded nucleic acid is heated up to the point at which it denatures, allows the melt temperature to be determined.

By monitoring the change in fluorescence from the dye as the PCR progresses (and it will progress only if at least some target nucleic acid is present in the sample initially) the bulk change in the amount of nucleic acid present in the reaction mixture can be monitored. This type of system is described for example in EP-A-512334. In this system, fluorescence is measured once per cycle as a relative measure of product concentration. Furthermore, the cycle number where an increase in fluorescence is first detected increases inversely proportionally to the log of the initial template concentration.

Other fluorescent systems have been developed that are capable of providing additional data concerning the nucleic acid concentration and sequence. In many of these systems, fluorescently labeled probes, which are oligonucleotides which hybridise specifically to the amplified sequence, are included instead of or in addition to the intercalating dye.

Particular examples of such as system are available commercially as the "Taqman"™ system, but there are many others including some specific examples as set out in WO/9746707A2, WO/9746712A2, WO/976714A1, all published Dec. 11, 1997, the entire content of which are incorporated herein by reference.

In these more complex systems, more than one fluorophore, generally in the form of fluorescent labels, are incorporated into the reaction system. For example, in the Taqman™ system, a probe carrying two fluorescent labels is added to the system. The fluorescent signal from the labels is interactive using fluorescence energy transfer (FET), a particular type of which is fluorescence resonant energy transfer (FRET), so that light emitted from one label (the energy donor or reporter) is absorbed by the other label (the energy acceptor or quencher) when these two are in close proximity to each other on the probe. The probes are designed to be annealed to the amplified or target sequence during the extension phase of each cycle of the PCR. The polymerase enzyme utilized in this reaction is one which has a 5'-3'exonuclease activity, and therefore, when the probe is encountered during the extension, it is digested by the enzyme. This digestion results in separation of the two labels, meaning that FET or FRET can no longer occur, and the resultant signals from the labels changes as a result.

In these systems, sample analysis occurs concurrently with amplification in the same tube within the same instrument. This combined approach decreases sample handling, saves time, and greatly reduces the risk of product contamination for subsequent reactions, as there is no need to remove the samples from their closed containers for further analysis. The concept of combining amplification with product analysis has become known as "real time" PCR.

However, the fact that these systems produce complex and often overlapping signals, from multiple different fluorophores within the system means that complex signal resolution is required to determine the intensity of the signal from the individual fluorophores.

The complexity is further compounded in that PCRs are generally conducted in specifically constructed thermal cyclers, such as block heaters, which accommodate multiple reaction vessels at the same time. These are then cycled together, and the signals produced by each vessel monitored.

Of course, visible signals from dyes or probes are used in various other types of reactions and detection of these signals may be used in a variety of ways. In particular they can allow for the detection of the occurrence of a reaction, which may be indicative of the presence or absence of a particular reagent in a test sample, or to provide information about the progress or kinetics of a particular reaction.

As these types of reagents are used more widely, the way they are used becomes more and more complex. In many instances a reaction mixture may contain more than one such "signaling" reagent, and the signals from these may need to be detected or monitored over time, in order to provide a full set of information about the occurrence, nature or progress of a particular reaction.

Current systems for PCR fluorimetry often rely on detection systems such as monochrome detectors (CCD, photodiode, PMT, CMOS detectors etc.) which on their own will only detect the presence or absence of light, but cannot distinguish amongst light of different wavebands or colours. Therefore they are not able directly to differentiate between the various different fluorophore signals. This problem is often addressed by having an external means of separating or filtering light into different wavebands for detection at different points on the detector, or at different points in time.

These external means increase the cost, size and complexity of the instrument. Such external means often need to be precisely mounted for optical alignment, and this tends to reduce the robustness of the instrument or leads to increased size, weight and cost associated with the mounting. Specifically, such external means include moving filter sets, where multiple filters are combined in such a way that a physical actuator may position one of the filters in front of the monochrome detector, allowing for detection of a particular waveband.

Other systems use a fixed filter set or diffraction grating to produce separate wavebands, but in this case the wavebands are spatially separated on the detector, and this removes the ability of the sensor simultaneously to detect emissions from an entire two-dimensional arrangement of vessels. This leads to the need for a scanning or other moving system to direct emissions from different vessels to the detector, or to move the vessels into alignment with the detector.

Many such chemical or biochemical reactions take place in an apparatus having a number, sometimes a large number, of receptacles arranged in an array. In order not to affect the reaction, the receptacles are often formed from polypropylene as an array of wells in a plate. The wells are inserted into a metal block which is thermally controlled so that the wells are thermally controlled by thermal conductivity through the walls of the wells. For many reactions, a seal is provided over the top of the well to seal the contents. Such seals are, generally, transparent or translucent, to enable the emissions from the wells to be detected, as described above. The seals may be self-adhesive, or may be heat sealed to the rim of the well. However, the reaction in the well often produces vapour that evaporates and then may condense on the inner surface of the seal, thereby producing droplets on the inner surface of the seal causing the detection of emissions to be reduced. In order to heat the seal and prevent condensation on the lower surface thereof a heated lid is often positioned over the upper surface of the seal. Furthermore, because the reaction in the well may produce substantial pressure in the well, especially at higher temperatures, the heated lid is commonly made to provide pressure on the upper surface of the seal to try to stop it expanding and/or exploding away from the rim of the well. Even small failures in the sealing layer can lead to loss of well contents due to evaporation, potentially leading to cross contamination of the wells, changes in well concentration leading to alterations to optical and PCR properties, and in the worst case to contamination of the lab environment. Such contamination can be problematic, since the wells can contain amplified DNA which can affect subsequent work carried out in the lab.

However, the above known systems have several disadvantages that will become apparent during the subsequent description and aspects of the present invention are intended to overcome, or at least mitigate, some of these problems, either individually, or in combination.

Accordingly, in a first aspect of the present invention, there is provided a reaction vessel for a chemical or biochemical reaction, the vessel comprising a lower receptacle portion of a relatively thermally conductive material, and an upper portion of a relatively thermally insulating material.

In a preferred embodiment, the lower portion is formed of a relatively thermally conductive polymer, such as polypropylene with a thermally conductive filler.

In a preferred embodiment, the upper portion is formed of a relatively thermally insulating polymer, such as polypropylene.

The upper portion and the lower portion may be formed by molding, for example by overmolding the lower portion over the upper portion or vice versa. Alternatively, the upper and lower portions maybe formed by two-shot molding in any order. The upper portion may include a tab for handling the reaction vessel.

According to a second aspect, the invention provides a reaction vessel for a chemical or biochemical reaction, the vessel comprising at least a lower, receptacle portion of a relatively thermally conductive material, and an upper portion having a rim defining an aperture allowing access to the lower portion, the lower portion having at least a pair of opposite substantially flat side walls for thermally contacting a heat mount for thermally controlling an interior of the reaction vessel.

In a preferred embodiment, the pair of substantially flat side walls are parallel to a transverse axis of the reaction vessel. At least the lower portion of the reaction vessel may have a substantially constant cross section along the transverse axis. The lower portion may be downwardly tapered. The reaction vessel may further comprise a pair of opposite end walls between the side walls. The opposite end walls may be flat. In one embodiment, the side and end walls may have an inverse truncated pyramidal configuration culminating in a lowermost flattened apex.

The side and end walls may have a truncated prism-like configuration culminating in a flattened groove extending parallel to the transverse axis.

According to a third aspect, the invention provides an array of reaction vessels of any of the types described above, the array having a plurality of rows of reaction vessels, where each row extends parallel to the transverse axis. The rows of reaction vessels may be joined along the transverse axis to form rows having a substantially constant cross section.

According to a fourth aspect, the invention provides an array of reaction vessels of any of the types described above, the array having a plurality of parallel rows of reaction vessels. At least the lower portions of at least some of the reaction vessels may be of an inverted conical shape. The upper portions of the reaction vessels may be molded together to connect the reaction vessels to form the array and/or to form a skirt whereby the array can be easily handled.

According to a fifth aspect, the invention provides an apparatus for a chemical or biochemical reaction, the apparatus comprising at least one reaction vessel having a lower receptacle portion of a relatively thermally conductive material for receiving, in use of the reaction vessel, chemical and/or biochemical reactants for the chemical or biochemical reaction, and an upper portion having a rim defining an aperture allowing access to the lower portion, a seal having an internal and an external surface for covering the rim when the reactants have been loaded into the receptacle portion, and a heated lid to be applied over the external surface of the seal to heat the seal to thereby reduce condensation on the internal surface of the seal, wherein a thermal barrier is provided between the lower portion of the reaction vessel and the heated lid.

In a preferred embodiment, the thermal barrier is located between the lower portion of the reaction vessel and the seal. The thermal barrier may be provided by an upper portion of the reaction vessel. Alternatively, or additionally, the thermal barrier may be formed by the seal. The seal may be self-adhesive for contacting the rim of the upper portion of the reaction vessel. Alternatively, the seal may be heat sealed to the rim of the upper portion of the reaction vessel. The seal may be formed of polyester material.

The thermal barrier may be located between the seal and the heated lid. The thermal barrier may comprise a relatively thermally insulating conformal layer. The thermally insulating conformal layer may be formed of an optically transparent silicone material that should be temperature resistant at the temperatures used.

In a sixth aspect, the invention provides an apparatus for a chemical or biochemical reaction, the apparatus comprising at least one reaction vessel having a lower receptacle portion of a relatively thermally conductive material for receiving, in use of the reaction vessel, chemical and/or biochemical reactants for the chemical or biochemical reaction, and an upper portion having a rim defining an aperture allowing access to the lower portion, a seal having an internal and an external surface for covering the rim when the reactants have been loaded into the receptacle portion, and a heated lid to be applied over the external surface of the seal to heat the seal to thereby reduce condensation on the internal surface of the seal, wherein the heated lid is provided with a conformal layer for contacting the upper surface of the seal and, in use, for applying pressure to the seal around the rim of the upper portion of the reaction vessel so as to provide improved sealing thereof.

The seal may be self-adhesive for contacting the rim of the upper portion of the reaction vessel. Alternatively, the seal may be heat sealed to the rim of the upper portion of the reaction vessel. The seal may be formed of polyester material. Again, the conformal layer may be formed of an optically transparent silicone material that should be temperature resistant at the temperatures used.

In a seventh aspect, the invention provides an apparatus for a chemical or biochemical reaction, the apparatus comprising at least one reaction vessel having a lower receptacle portion of a relatively thermally conductive material for receiving, in use of the reaction vessel, chemical and/or biochemical reactants for the chemical or biochemical reaction, and an upper portion having a rim defining an aperture allowing access to the lower portion, a seal having an internal and an external surface for covering the rim when the reactants have been loaded into the receptacle portion, and a heated lid to be applied over the external surface of the seal to heat the seal to thereby reduce condensation on the internal surface of the seal, wherein the heated lid is controlled so as to produce sufficient heat and pressure on the seal as to heat seal the seal to the rim of the reaction vessel.

The lower portion of the reaction vessel may be formed of a relatively thermally conductive polymer, which may be polypropylene with a thermally conductive filler.

The apparatus may, in one embodiment, comprise an array of the type described above, the array being positioned in a heat mount, the heat mount being in thermal contact with at least the lower portion of the reaction vessels, and the heat mount being controlled to provide thermal control of an interior of the reaction vessel.

The heat mount may be provided with a plurality of parallel grooves into which the parallel rows of reaction vessels are positioned. In one embodiment, when lower portions of the reaction vessels are provided with substantially flat side walls, the grooves have substantially flat sides for contacting the side walls of the reaction vessels.

The heat mount may comprise one or more hollow sections between adjacent parallel grooves. Furthermore the heat mount may include a heat pipe provided in at least one of the hollow sections. The heat mount may include at least one temperature sensor mounted in at least one of the hollow sections.

The heat mount may include insulating material provided within at least one of the hollow sections. The heat mount may be divided into two or more separately thermally controlled parts, each part having one or more grooves for independently thermally controlling the reaction vessels positioned in those grooves.

In a further aspect, the invention provides a system for a chemical or biochemical reaction, the system comprising an array of reaction vessels, each reaction vessel having a receptacle portion for receiving, in use, chemical and/or biochemical reactants including at least a dye for the chemical or biochemical reaction, and an optical detector system positioned at a height above the array for detecting optical signals generated in the reaction vessels during the chemical or biochemical reaction, wherein the receptacle portion of each reaction vessel in the array is defined by a side wall which is downwardly inclined to the vertical at an angle which is at least equal to a maximum angle to the vertical of a line of sight between the optical detector system and outermost reaction vessels in the array that allows the optical signals from a lowermost part of the reaction vessels to be detected by the optical detector system.

In a preferred embodiment, the optical detector system comprises an optical sensing device, but does not include an optical system for substantially altering the angle of the line of sight between the optical sensing device and the lowermost parts of the outermost reaction vessels in the array. The system may further comprise an apparatus as described above.

The reaction may be a Polymerase Chain Reaction or other types of chemical reactions such as, for example, Ligase Chain Reaction, Nucleic Acid Sequence Based Amplification, Rolling Circle Amplification, Strand Displacement Amplification, Helicase-Dependent Amplification, or Transcription Mediated Amplification.

One embodiment of a system incorporating various aspects of the invention will now be more fully described, by way of example, with reference to the drawings, of which:

Figure 1:
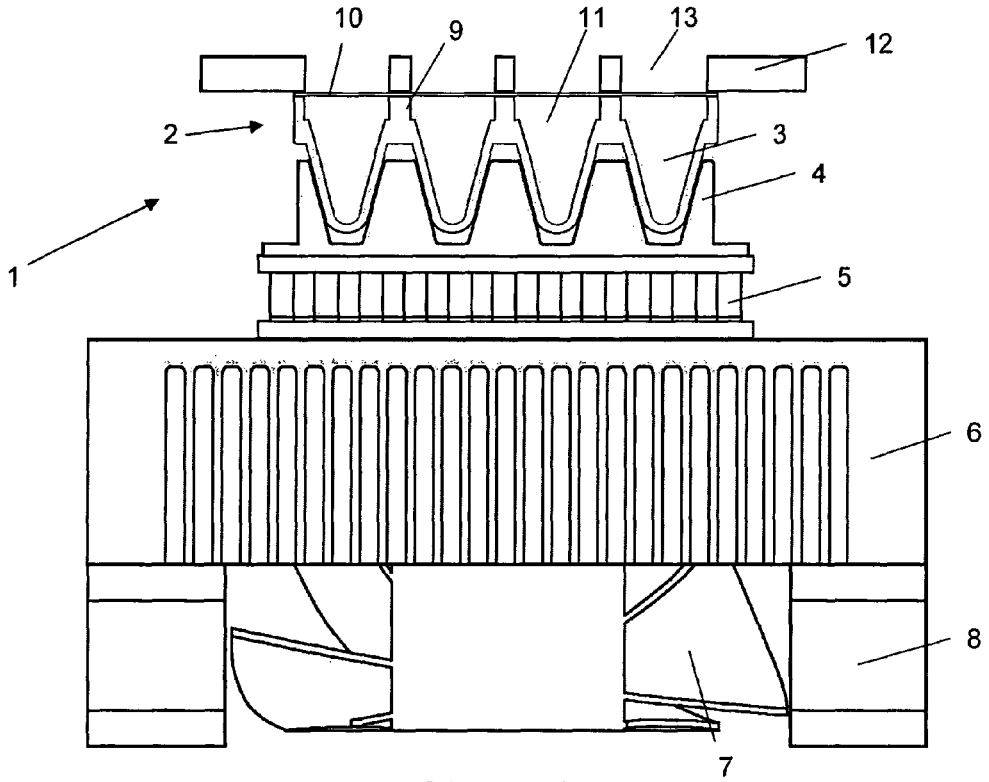
FIG. 1 shows a schematic diagram of a conventional PCR system.

Thus, as shown in FIG. 1, a conventional PCR system 1 includes an array 2 of vessels 3. The array 2 is positioned in a thermal mount 4 positioned on a heater/cooler 5, such as a Peltier module, of the well-known type. As is known, a Peltier module can be used to heat or cool and the Peltier module is positioned on a heat sink 6 to provide storage of thermal energy, as required. The heat sink 6 is provided with a fan 7 mounted on a fan mounting 8 on the lower side of the heat sink 6 in order to facilitate heat dissipation, as necessary.

The thermal mount 4 is made of a material with good thermal conductivity, usually metal, such as copper, and is provided with depressions, into which the vessels 3 fit so that the temperature in the vessels 3 can be controlled by controlling the temperature of the thermal mount 4. The vessels are conventionally made of polypropylene. Each vessel 3 of the array 2 is formed in the general shape of a cone and has an upper edge 9 defining a perimeter of an aperture 11 providing access to the vessel 3. The array 2 is covered by a relatively thin film 10, which is sealed to the upper edges 9 of the vessels 3 to keep the reagents and reaction products within each vessel 3. Because substantial pressures may be produced during the course of the reactions in the vessels 3, the film 10 is clamped between the edges 9 of the vessels 3 and an upper clamping member 12, to reduce the chances that the film 10 separate from the edges 9 under higher pressures and allow the reagents and/or reaction/products to escape and/or to mix. In order to allow the interiors of the vessels to be examined during the course of the reactions taking place, the film 10 is made of a transparent or translucent material and the clamping member 12 is provided with apertures 13 in register with the apertures 11 of the vessels 3 to provide visual access to the interiors of each of the vessels 3.

As was mentioned above, however, the conventional PCR system 1 has a number of disadvantages which will become apparent. Firstly, as already mentioned, the reactions in the vessels 3 may well produce vapour that evaporates and then may condense on the inner surface of the film 10, thereby producing droplets on the inner surface of the film, which may cause the visibility of the interior of the vessels 3 to be reduced. In order to heat the film 10 and prevent condensation on the lower surface thereof a heated lid is often positioned over the upper surface of the film 10. The heated lid is usually formed of glass with a heating element positioned on one surface thereof, or embedded within the lid and the lid is made heavy enough that it provides the clamping force necessary to try to stop it expanding and/or exploding away from the rims of the apertures 11 of the vessels 3.

Since polypropylene is thermally insulating, it generally takes some time for the heat from the thermal mount to pass through to the interior of the vessels, and it is difficult to accurately control the temperature inside the vessels and change it rapidly. It has been suggested to produce such vessels from a thermally conductive material. However, given that the heated lid is clamping the thin film to the upper edges of the vessels, a substantial amount of thermal energy would then be conducted away from the heated lid by the thermally conductive material forming the vessels 3 Apart from the loss of thermal energy, this would also affect the temperature in the vessels in a non-controlled fashion and therefore adversely affect the accurate control of the temperature in the vessels.

Figure 2:
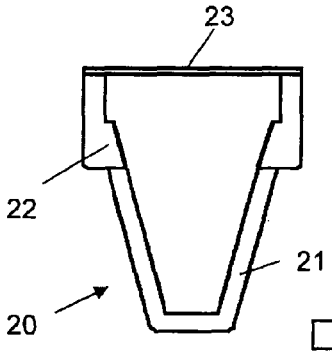
FIG. 2 shows a cross-sectional view through one reaction vessel according to a first aspect of the invention used in the system of FIG. 1.

Accordingly, as shown in FIG. 2, in one embodiment, a first aspect of the invention provides a reaction vessel 20 for a chemical or biochemical reaction, in which a lower receptacle portion 21 is made of a relatively thermally conductive material, and an upper portion 22 is made of a relatively thermally insulating material. The sealing film 23 is also shown for completeness in FIG. 2.

Figure 3:
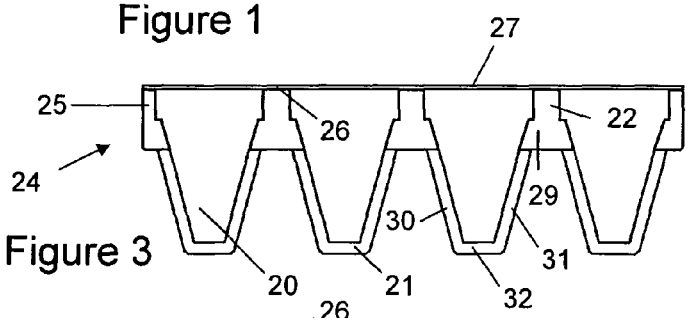
FIG. 3 shows an end cross-sectional view through an array of reaction vessels of the type shown in FIG. 2.
Figure 4:
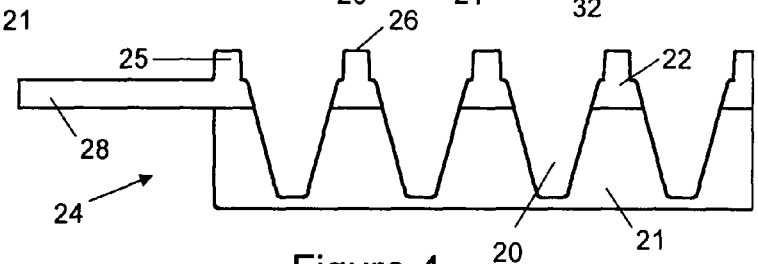
FIG. 4 shows a side cross-sectional view through an array of reaction vessels of the type shown in FIG. 2.
Figure 5:
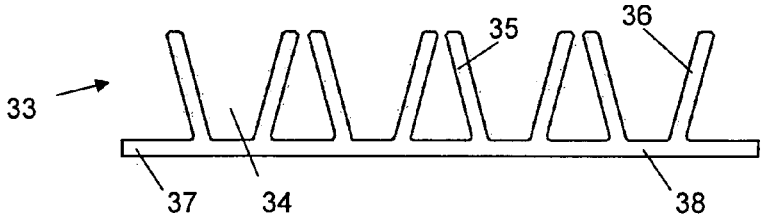
FIG. 5 shows a more detailed cross-sectional view of a thermal mount into which the array of FIGS. 3 and 4 may be positioned.

The vessel 20 is produced as part of an array 24 shown in more detail in FIGS. 3 and 4 produced from an upper part 25 and a lower part 21, molded from two different polymers. The array 24 is formed as a series of generally triangular prism shaped rows of vessels 20, with each row containing a series of truncated square-based pyramidal vessels 20, which are depressions in the otherwise solid triangular prisms. The angled sides of the prisms are the surfaces of contact for the thermal mount 33, which has generally triangular grooves 34 running along it, as shown in FIG. 5, for the vessels 20 to seat into. As can be seen from the Figures, the cross sections are not, strictly, triangular, but truncated, where the bottoms of the vessel rows are truncated to form a trapezoidal shape.

The upper part 25 of the array 24, providing the upper portion 22 of each vessel 20, is made from a thermally insulating (TI) polymer (also of low thermal capacity), such as polypropylene. The upper part 25 provides the upper edge 26 of each vessel 20, to which sealing film 27 can be applied, and defines square apertures to allow access to the vessels 20. The sealing film 27 can be either self-adhesive, or can be heat sealed to the upper edges 26. As will be more fully explained below, a heated lid can be used to apply pressure to this upper edge 26 via the sealing film 27, whilst the disposable is in use. This upper edge 26 thus forms, essentially, a two dimensional grid with square holes. The upper part 25 is also provided, as shown in FIG. 4, with a tab, for handling the array 24 without touching the vessels 20. The tab 28, being of thermally insulating material, can be handled without danger of it being too hot and is also large enough to carry a logo, text and/or a 2D barcode for tracking (this could be read from above by the same optical system used for fluorescence measurements). The tab 28 also provides an alignment feature to prevent insertion of the array in a wrong orientation into the thermal mount, since otherwise it would be possible to insert it rotated by 180 degrees, which would work physically but produce confusing results. The upper part 25 is also provided with dividers 29 projecting down from the upper edges 26, between each pair of vessels 20 in a row and at the end of the rows. These dividers 29 form a low-thermal-mass volume between the walls of the vessels. In some embodiments, the upper part 25 could also be provided with a skirt around the array to allow it to stack with other arrays, and for automated handling. Such a skirt may be made so as to comply with various industry standards, such as the MTP specification. Such a skirt may replace the tab 28.

The lower part 21 is made from a thermally conductive (TC) polymer, such as polypropylene with a thermally conductive filler (e.g. carbon based or boron nitride) and is molded onto the upper part 25. The lower part 26 provides a series of inverted truncated pyramidal "shells" forming the actual container of each vessel 20, of which the interior surface contains the reagent volume, and two sides 30, 31 of the outer surface make contact with the thermal mount. The "base" of the pyramids provides the open apertures to allow filling and optical access to the interior of the vessels. The lower part 21 also provides joining planes between each pyramidal shell, to make a roughly triangular prism shape (actually a trapezoidal prism).

Advantages of having two different parts of two different polymers, one thermally conducting and one thermally insulating, is that the thermally conducting polymer can be used only where it is needed to conduct heat rapidly into and out of the vessel, and between vessels for uniformity. Other regions can be made from thermally insulating polymer, reducing loss of thermal energy from the array into the surroundings that can slow heating, and produce undesirable temperature gradients. In particular, the region in contact with the heated lid can be made thermally insulating, thereby greatly reducing the undesired influence of the heated lid temperature on reaction volume temperature whilst still preventing condensation. The thermal capacity of the array can also be reduced since the thermally insulating polymer has a lower specific heat capacity than the thermally conducting polymer, so that less thermal energy needs to be added to or removed from the array to alter temperature.

The truncated pyramidal vessels 20 have a flat bottom 32 with width/height greater than a standard pipette size. A pipette inserted most of the way into the vessel will thus be automatically aligned to this flat bottom, and hence the vessel will fill easily. In this position the pipette will also recover most of the sample. The sloping walls of the vessel also discourage beading of the sample which can occur in vessels with vertical walls.

Each of the upper and lower parts can be molded using standard injection moulding technology. The thermally insulating part is produced first, and then inserted into a second mold where the thermally conductive polymer is overmolded to add the second part and complete the array. Alternatively, the thermally conductive part could be made first and then overmolded with the thermally insulating part. Other molding processes could alternatively be used e.g. a 2-shot molding process. It will be apparent, therefore, that in the preferred embodiment, only thermally conductive polymer is present along the heating path from the thermal mount 33 to the reagent volume, increasing thermal performance. It will be apparent, furthermore, that the thermally conducting material need not be a polymer, but could be other thermally conductive material, such as, for example, metal foil.

It will also be apparent that, in accordance with a second aspect of the invention, in the preferred embodiment, each vessel 20 of the array 24 has a pair of opposite outer planar faces 30, 31 for contact with the thermal mount. These outer faces 30, 31 are substantially flat, and form a downwardly tapered shape, allowing for good contact with the thermal mount when the array 24 is positioned into it. The substantially flat side walls are provided generally parallel to a transverse axis of the reaction vessel, at least the lower portion of the reaction vessel having a constant cross section along the transverse axis. Each vessel also has a pair of opposite end walls between the side walls, which end walls are also flat, thereby defining the inverse truncated pyramidal configuration culminating in a lowermost flattened apex and the side and end walls have a truncated prism-like configuration culminating in a flattened groove extending parallel to the transverse axis.

The array 24 will, in general, have a plurality of rows of the reaction vessels, where each row extends parallel to the transverse axis. Alignment of the reaction vessels in the thermal mount is thus self-correcting, as pressure will seat the array lower into the thermal mount until the array is aligned and in good conformal contact. Any expansion of the vessels during heating will be allowed for by this geometry. Standard formats, such as the Microtitre Plate may be used for the spacing and other dimensions of the reaction vessels, as these are suitable for stacking and robotic handling, and fairly robust, etc. However, this is not always possible for all formats.

FIG. 5 shows an embodiment of the thermal mount 33 which provides easy alignment of the array of vessels therein, particularly as compared to the conventional vessels described above. It will be clear that with the conventional arrays of substantially conical vessels, the array could be fitted into the thermal mount in any of four lateral configurations. The present array and mount, however, only permits two lateral configurations because of the way the rows of vessels of the array must fit into a groove 34 in the thermal mount 33. As can be seen, the grooves 34 are defined by pairs of longitudinal walls 35, 36 extending upwardly from a base 37 at diverging angles, with the groove having a flat bottom 38 corresponding to the flat bottom 32 of the vessels 20. Clearly, the diverging angle of the longitudinal walls 35, 36 substantially matches the tapering angle between the side walls of 30, 31 of the vessels, so that good contact is made between the vessels and the thermal mount.

The thermal mount 33 may be made of an extruded form, having a constant cross section along its length. This enables manufacturing by wire cutting for high precision, or extrusion for reasonably good precision and much lower cost. The mass of the thermal mount can be substantially reduced, as compared to conventional solid thermal mounts, by removing the material not in immediate contact with the vessels of the array. As can be seen, this would be much harder (and general manufacture is also harder) for a solid thermal mount requiring an array of depressions for vessels not formed as rows. Reduced mass is also an important factor in increasing the rate at which the mount itself is heated and cooled, which can be a limiting factor in final reagent volume heating/cooling rates.

The thermally insulating, low thermal mass elements between the vessels reduces the thermal capacity of the array for faster cycling, and also insulates the walls of the vessels that are not in contact with the thermal mount. This allows for the thermally conducting walls of the vessels to rapidly equilibrate, and assist the reagent volume in equilibrating. The thermally conducting walls of the vessels are connected together into contiguous rows, so that only one path is required to fill each row during injection molding. By contrast if each vessel had an isolated thermally conducting volume, each vessel would need a separate flow path for molding, greatly increasing cost and complexity.

For applications where a large reaction volume is important, it is possible to join together two or more adjacent vessels in a row to form a longer vessel with much greater volume capacity. Even with such vessels of larger volumes, the same thermal mount can be used, since the geometry can accommodate multiple different arrays with different vessel volumes. Clearly, using the same thermal mount means that the rest of the apparatus can also be used.

Figure 6:
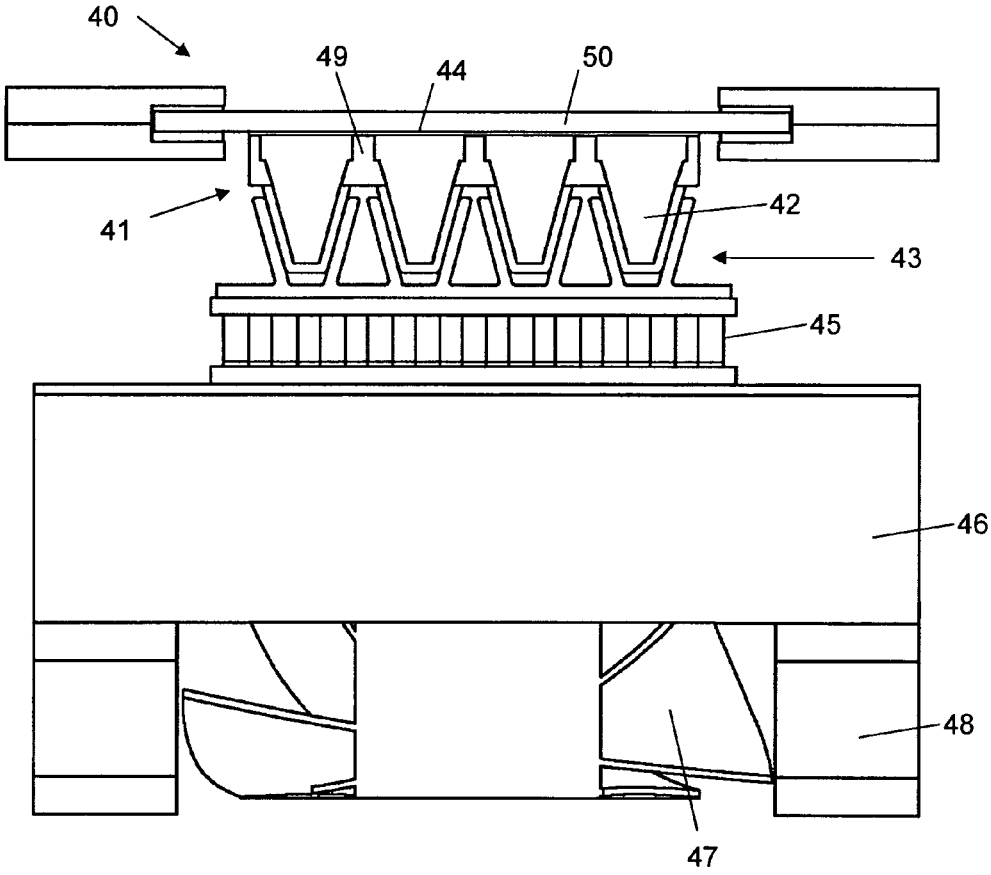
FIG. 6 shows a cross-sectional view through part of a PCR system according to one embodiment of the invention showing a reaction vessel of the type shown in FIG. 2, 3 or 4, in use, positioned in a thermal mount of the type shown in FIG. 5, together with a seal and a heated lid.

Turning now to FIG. 6, there is shown an apparatus 40 in which an array 41 of reaction vessels 42, which is preferably similar to that described above with reference to FIGS. 3 and 4, is mounted on a thermal mount 43, which is preferably similar to that described above with reference to FIG. 5. The remainder of the apparatus is essentially similar to that described above with reference to FIG. 1. Thus, the thermal mount 43 is positioned on a on a heater/cooler 45, such as a Peltier module, of the well-known type. As is known, a Peltier module can be used to heat or cool and the Peltier module is positioned on a heat sink 46 to provide storage of thermal energy, as required. The heat sink 46 is provided with a fan 47 mounted on a fan mounting 48 on the lower side of the heat sink 46 in order to facilitate heat dissipation, as necessary.

The array 41 is covered by a relatively thin film 44, which is sealed to the upper rims 49 of the vessels 42 to keep the reagents and reaction products within each vessel 42. Because substantial pressures may be produced during the course of the reactions in the vessels 42, the film 44 is clamped between the upper rims 49 of the vessels 42 and a heated lid 50, to reduce the chances that the film 44 separates from the upper rims 49 under higher pressures and allow the reagents and/or reaction/products to escape and/or to mix. In order to allow the interiors of the vessels to be examined during the course of the reactions taking place, the film 44 is made of a transparent or translucent material and the heated lid 50 is also made of a transparent or translucent material, e.g. glass to provide visual access to the interiors of each of the vessels 42.

It will this be seen that the vessels 42 are placed in the thermal mount 43 which makes contact with the outer surface of the vessels, providing heating to the vessel by conduction. For convenience the term "mount" will be used as a general term for the element the vessel is held in for thermal control. However, it should be clear that many different geometries are possible, even with the same vessel shape. In conventional thermal cyclers the mount is a solid metal block, with a thermal control element like a Peltier module on the underside, and the array of vessels placed into machined wells on the upper surface of the metal block. Alternatively a thermal cycler could have smaller thermal control elements in direct contact with the disposable vessels. In some examples the mount is a fluid such as, for example a liquid or a gas.

There are generally one or more temperature sensors in contact with some part of the thermal mount or the array of reaction vessels, used as feedback for control of temperature.

The thermal mount will contain some form of temperature controller, commonly a resistive heater (e.g. nichrome wire, etched nichrome, etc.) or a heat pump, normally a Peltier element. This is controlled to achieve the required temperature profile.

After filling the reaction vessels with reagents the vessels must be sealed, to contain the reagents during PCR or other nucleic acid amplification methods. Effective containment is critical since cross-contamination during the reactions is a persistent technical challenge, as the DNA present in the vessels is amplified by a large factor, and if even a small quantity of this amplified DNA leaves a vessel and contaminates other reactions, it can then be amplified in subsequent reactions, or neighbouring vessels, resulting in false positive results.

For real-time PCR, the reagents in the disposable vessels are monitored optically. Fluorescent dyes are excited with one or more spectra of light, and the emitted spectrum of light is detected. One common example would be to use blue light to excite SYBR Green I dye, measuring the returned green light to detect the quantity of double stranded DNA present. The vessels needs to provide an optically transparent and non fluorescent window for excitation light to enter, and emitted light to leave the vessel. Analysis of the kinetics with which Nucleic Acids are amplified enables the estimation of the starting amount of target nucleic acid in the reaction volume.

During thermal cycling, volatile components of the reaction mixture (for example water) tend to evaporate. This changes the concentration of the reagent solution (potentially resulting in changes in the efficiency of the amplification process), produces heat loss from the reaction volume (giving unpredictable temperature control), and can cause condensation on the inside surfaces of the vessel, including the optical window. The latter problem reduces the amount of excitation light entering, and emitted light leaving the vessel, affecting optical measurements, thus introducing noise into the measured optical signal. To avoid this, the heated lid is provided, which warms the optical windows of the vessels, reducing condensation. This is often combined with a second function of applying downwards pressure to the vessel. This is used to provide both improved thermal contact between the vessel and the mount and also help maintain effective sealing of the reaction vessels.

Figure 7:
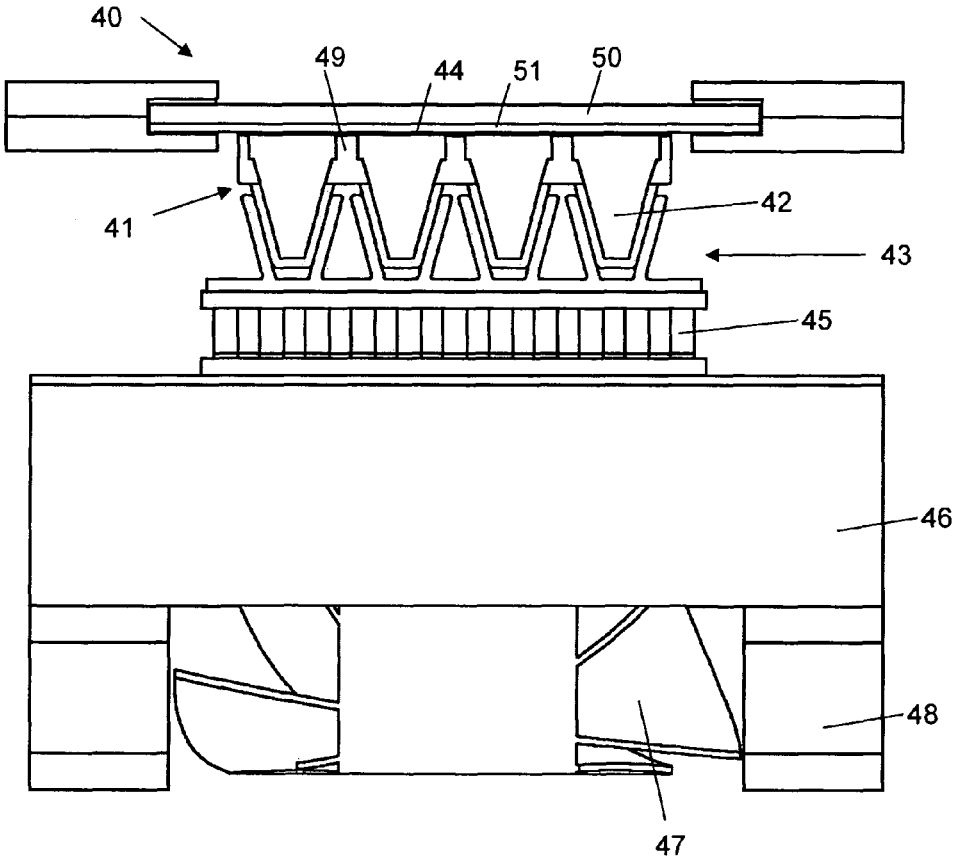
FIG. 7 shows a view similar to that of FIG. 6, but with a thermally insulating conformal layer positioned between the heated lid and the seal.

Nevertheless, in some cases, the tops of the upper rims of all the reaction vessels in the array may not be precisely in the same plane. Since the heated lid is usually fairly flat and rigid, any imperfections in the coplanarity of the upper rims of the reaction vessels of the array may result is the heated lid not providing the downward pressure on the seal all the way around each of the vessels, with the result that, in some cases, the seal may lift from a rim and allow materials to escape. Thus, in order to try to mitigate this possibility, the apparatus may include a conformal layer on the underside of the heated lid, between the lid and the seal. This is best shown in FIG. 7 in which the same elements as in the apparatus of FIG. 6 are shown with the same reference numerals and will not be described in detail again. Thus, as shown in FIG. 7, a conformal layer 51 is provided between the heated lid 50 and the seal 44. The conformal layer 44 can be made of any suitable material, but it will be apparent that it should be optically transparent or translucent to allow optical access from above the heated lid and into the reaction vessels, and it should be relatively soft or spongy to allow it to conform to the shape and any imperfections of the upper rims of the reaction vessels.

Figure 8:
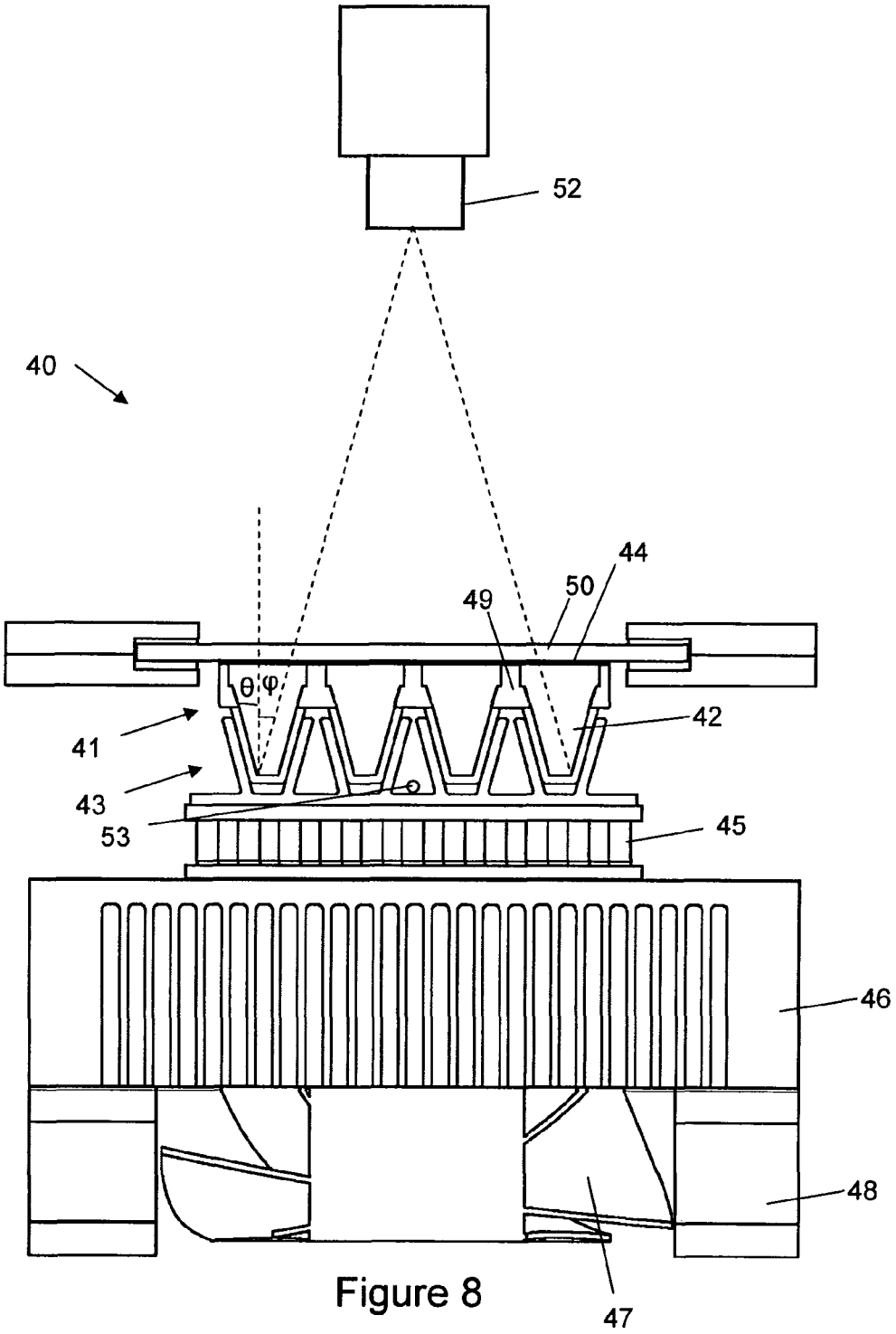
FIG. 8 shows the PCR system of FIG. 6 with an optical detector system positioned above the array of reaction vessels.

A PCR system is shown in FIG. 8, in which, again, the same elements as in the apparatus of FIG. 6 are shown with the same reference numerals and will not be described in detail again. In this system, however, there is provided an optical detection system 52 provided above the heated lid 50. After preparation and loading, the vessels are subjected to a controlled thermal profile. The ideal aim is to take a body of liquid in a vessel, and at any given point in time, achieve an exact uniform temperature throughout the body of liquid. The PCR reaction itself is driven by temperature changes, and the properties and behaviour of DNA, enzymes and the dyes used for optical readings are all strongly dependent on temperature. Hence any inaccuracy in temperature control will greatly affect the quality of results, or even prevent the reaction occurring or being measured at all. The speed of thermal control directly affects the rate at which PCR can be performed, thus affecting the time required for a successful experiment, as well as the success of that experiment (the enzymes and other reagents used degrade at higher temperatures). Any non-uniformity in the temperature of reagents (either within an individual vessel or between different vessels) can also affect the efficiency of the amplification reactions, and hence the precision of the resultant measurements. Furthermore in many cases subsequent to the amplification of Nucleic Acids the nature of the amplified nucleic acids is determined by measuring their thermal stability. Once the PCR reaction is complete, the temperature of the reaction volume is slowly increased, and a process analogous to melting takes place around a certain temperature, said temperature dictated by the nature of the amplified nucleic acids, with optically detectable results. If the temperature in a vessel is uniform, the DNA will melt throughout the vessel at the same time yielding a sharp transition in optical properties—if the reaction volume has different regions at different temperatures these will melt at different times giving a less discrete peak, potential compromising 1) the amount of amplified nucleic acids that can be analysed by this method 2) the number of different species of nucleic acids that can be discriminated in a single reaction volume and 3) the precision and accuracy with which the "melting properties" of nucleic acids can be determined. Thus, as also shown in FIG. 7, the thermal mount is provided with a temperature sensor 53 provided in one of the channels of the thermal mount between the tapering longitudinal walls 35, 36. This sensor is coupled to the temperature controller (not shown, that controls the Peltier module 45. Although in some cases a single sensor will suffice, if the heat distribution across the thermal mount is uniform, in other cases, more than one temperature sensor can be provided at intervals in a single channel and in different channels of the thermal mount to make sure that each vessel across the array is at the same temperature so that each will melt at the same measured temperature.

In a system where heat is conducted into and out of the reagent volume, the reagent volume must equilibrate. This occurs as thermal energy is conducted from the outer surface in contact with the vessels, through the volume, principally through conduction and convection, with the "center" of the volume lagging behind. The speed of equilibration is affected by the reagent properties, which is not affected by the geometry of the vessels, but also by the shape of the vessel, with better performance given by a larger surface area for heating, and a volume with a low maximum distance from the surface to a point in the volume (the longest distance heat has to be conducted to reach the inside of the liquid).

As described above, the shape of the cavity provided for the reagent determines its shape and hence equilibration. In addition the thickness of vessel walls and the area in contact with the block on the outside and reaction volume on the inside affect the thermal resistance offered by the vessel walls—the lower this is, the greater the rate of heating and cooling through the vessel walls. The thermal conductivity of the regions of the vessel through which heat is conducted also, of course, directly influences the rate of conduction.

Ideally, complete conformal contact should be made with the thermal mount by the outer surfaces of the vessels. This will result in the least thermal resistance between the contacting, and therefore help improve inter vessel uniformity. Where contact is made only in patches or at small points, performance will be lowered and non-uniformity produced. Although equilibration may result eventually, set temperatures may not be held long enough for this to occur, imposing the risk that critical temperatures required for efficient nucleic acid amplification are not reached. This can be affected by the vessel material, surface finish and geometry, and also thermal mount geometry.

During the experiment, the reaction will be monitored by the optical detection system 52. Ideally, the reagent volume should be entirely optically accessible at all wavelengths from all angles. However, in order to do so effectively, detection systems using light excitation must have a clear line of access to the maximum liquid content. Where an imaging detector, such as a CCD or CMOS sensor with an optical system, is used, there should be a clear path into the optical system for emitted light to be collected by the sensor. Furthermore systems measuring an array of points across the field of view must have optimal coverage (ratio of space occupied by vessel windows to blank space between them) for the most efficiently use of the sensor. Accordingly, as shown in FIG. 7, the side walls of the vessels are downwardly inclined to the vertical at an angle $\kappa$ which is at least equal to a maximum angle $\phi$ to the vertical of a line of sight between the optical detector system 52 and outermost reaction vessels in the array. This allows the optical signals from a lowermost part of the reaction vessels to be detected by the optical detector system 52.

For any sensor(s), the efficiency with which excitation light reaches each reaction and emitted light is collected influence two factors. The returned optical signal (for a given reagent state) is roughly the product of excitation intensity and emission collection efficiency, and so if either varies between vessels, they will not produce the same signal in the same state. This can be corrected for by signal processing, but ideally the original signal should be uniform across the plate. The main effect is that most sensors have a limited dynamic range, and must be set so that the "brightest" vessel does not saturate them. If the "dimmest" well is much less intense than the brightest, it will not be measured with the best precision or signal to noise. The stronger the excitation and the better the efficiency of collection of emitted light for a given well, the better then signal to noise ratio and the lower the level of dye (response) that can be detected. Generally the wavelengths used are visible (for excitation and emission), but may extend down to UV for excitation and IR for emission, although this makes optical design more difficult since many common optical and sealing materials are not transparent to UV. Good transmission over visible wavelengths is offered by plain polypropylene. More unusual polymers can be used for UV transmission, but achieving (physical and biological) compatibility with PCR can be more difficult.

Since the excitation is generally very much more intense than the resulting fluorescent emission, it needs to be distinguished from emission. Generally this is done via filtering, where the excitation source is chosen (or band-pass filtered) to have a fairly narrow spectrum and this spectrum is then blocked by a filter over the optical sensor. Different variations are possible using dichroic mirrors etc, but generally filtering of some form is involved. If the vessels are more reflective, then the reflected excitation light passing through the reagent volume for a second time may produce more fluorescent excitation, and since the fluorescent emission is omnidirectional a reflective vessel may emit light that would otherwise be missed back to the optical sensor. Thus, making the material of which the vessel is formed more reflective, for example by adding a reflecting material to the polymer forming the lower portion of the vessels may be desirable in some cases. Minimising the intrinsic fluorescence of the vessel materials is also important as this may interfere with the measurement of the actual reaction fluorescence.

For some applications, the measurements performed in the apparatus itself (temperature and optical measurements) are sufficient for analysis, and the samples themselves are of no further use. However for other applications, the samples may be further analysed in the array of vessels, or more often after being recovered from the vessels. For this reason, it should be possible to remove the sealing film without disturbing the contents (contents should not be held against the sealing film where they might adhere, and the force required to remove the seal should be allowed for without ejecting the contents). It should also be possible to recover the sample from the vessels, generally using a pipette, with a reasonable efficiency. Ideally there should be no areas of the vessel where the liquid is inaccessible, etc.

From the above description, it will be apparent that the array of reaction vessels provides the advantages that they can be easily stored prior to use, tracked and possibly handled by automated systems. Furthermore, the reaction vessels are so shaped that it is possible to fill the vessel without the formation of bubbles in the absence of strict requirements for positioning of the pipette tip, or the flow rate of liquid. The liquid does not "bead" in the vessel, but forms a neat layer in the bottom of the vessel. This allows for easier sealing since the liquid will not come into contact with the sealing film (if this is used).

The vessels of the array may be filled in stages, with movement and/or chilling (to preserve DNA/enzymes etc.) between stages. This is easy to do by hand or in an automated system. The vessels are also easy to seal, with a reliable seal being formed between the vessels and the environment, and between vessels (particularly neighbouring vessels). This seal is effective on its own at room temperature, and effective at higher pressures (with the assistance of a heated lid or other elements of the system) during thermal cycling. Alternate common sealing methods apart from a film bonded to the disposable by adhesive or heat, are caps pushed into the vessels. The vessels are also easy to load into the apparatus by hand or automated processes, with an obvious correct alignment which can be enforced by means of markers, geometry of the vessels, etc. It will be hard to damage the array of vessels or the apparatus by incorrect loading, unless this incorrect loading is readily apparent to the user.

It will be appreciated that although only a few particular embodiments of the invention have been described in detail, various modifications and improvements can be made by a person skilled in the art without departing from the scope of the present invention.

The invention claimed is:

1. An apparatus for a chemical or biochemical reaction, the apparatus comprising:

a thermally controlled heat mount;

at least one reaction vessel, the reaction vessel having:

a lower, walled receptacle portion including walls formed of a relatively thermally conductive material having a first thermal conductivity, the lower, walled receptacle portion being for receiving, in use of the reaction vessel, chemical and/or biochemical reactants for the chemical or biochemical reaction, the lower, walled receptacle portion being configured for enabling thermal energy to be conducted between an interior of the lower, walled receptacle portion of the reaction vessel and the heat mount via the walls of relatively thermally conductive material; and an upper portion forming an extension to the walls, the extension to the walls having a rim at an upper end of the extension to the walls, the rim defining an aperture allowing access to the lower, walled receptacle portion, wherein the upper portion is formed of a relatively thermally insulating material having a second thermal conductivity that is less than the first thermal conductivity, whereby the extension to the walls reduces the amount of thermal energy conducted between the lower, walled receptacle portion and the rim;

a seal having an internal surface and an external surface, the seal being configured for covering the rim and the aperture defined thereby when the reactants have been loaded into the lower, walled receptacle portion;

and a heatable lid appliable over the external surface of the seal to heat the seal to thereby reduce condensation on the internal surface of the seal in use, wherein the upper portion provides a thermal barrier between the lower, walled receptacle portion of the reaction vessel and the seal.

2. An apparatus according to claim 1, wherein the lower, walled receptacle portion is formed of a relatively thermally conductive polymer and the upper portion is formed of a relatively thermally insulating polymer.

3. An apparatus according to claim 1, further comprising an array having a plurality of parallel rows of reaction vessels including the at least one reaction vessel, the array being positioned in the thermally controlled heat mount, wherein the walls of the lower, walled receptacle portion of each at least one reaction vessel comprise at least a pair of opposite flat side walls that are parallel to a transverse axis of the reaction vessel and in thermal contact with the heat mount, and a controller for controlling the heat mount to provide thermal control of the interior of the lower, walled receptacle portion of the reaction vessel, wherein each row of reaction vessels extends parallel to the transverse axis.

4. An apparatus according to claim 3, wherein the heat mount is provided with a plurality of parallel grooves into which the parallel rows of reaction vessels are positioned.

5. An apparatus according to claim 2, wherein the relatively thermally conductive polymer comprises a polypropylene with a thermally conductive filler.

6. A reaction vessel for a chemical or biochemical reaction, the reaction vessel comprising:

a lower, walled receptacle portion including walls formed of a relatively thermally conductive material, the relatively thermally conductive material having a first thermal conductivity, the lower, walled receptacle portion being for receiving, in use of the reaction vessel, chemical and/or biochemical reactants for the chemical or biochemical reaction, and an upper portion forming an extension to the walls, the extension to the walls having a rim at an upper end of the extension to the walls, the rim defining an aperture allowing access to the lower, walled receptacle portion, wherein the upper portion is formed of a relatively thermally insulating material, the relatively thermally insulating material having a second thermal conductivity, wherein the second thermal conductivity is less than the first thermal conductivity.

7. A reaction vessel according to claim 6, wherein the lower, walled receptacle portion comprises a polypropylene with a thermally conductive filler.

8. A reaction vessel according to claim 6, wherein the upper portion comprises polypropylene.

9. An array of reaction vessels, each reaction vessel being for a chemical or biochemical reaction, each reaction vessel comprising:

at least a lower, walled receptacle portion including walls formed of a relatively thermally conductive material, and an upper portion forming an extension to the walls, the extension to the walls having a rim at an upper end of the extension to the walls, the rim defining an aperture allowing access to the lower, walled receptacle portion, wherein the upper portion is formed of a relatively thermally insulating material, wherein the thermal conductivity of the upper portion is less than the thermal conductivity of the lower, walled receptacle portion, the walls of the lower, walled receptacle portion comprising at least a pair of opposite flat side walls for thermally contacting complementary flat side walls of a well of an array of wells in a heat mount, wherein the heat mount, in use, is controlled by a controller for thermally controlling an interior of the lower, walled receptacle portion of the reaction vessel, wherein the array having a plurality of rows of reaction vessels.

10. A reaction vessel according to claim 6, wherein the reaction vessel is located in an array of reaction vessels, the array having a plurality of rows of reaction vessels, and each of the reaction vessels in the array is according to claim 6.

11. An array according to claim 10, wherein the lower, walled receptacle portion is formed of a relatively thermally conductive polymer, and the upper portion is formed of a relatively thermally insulating polymer.

12. An array according to claim 10, wherein the upper portions of the reaction vessels are connected to form the array.

13. An apparatus according to claim 1, wherein the lower, walled receptacle portion is formed of a metal foil.

14. A reaction vessel according to claim 6, wherein the lower, walled receptacle portion is formed of a relatively thermally conductive polymer and the upper portion is formed of a relatively thermally insulating polymer.

15. A reaction vessel according to claim 6, wherein the lower, walled receptacle portion is formed of a metal foil.

* * * * *